US005218804A

United States Patent [19]

Campbell

[11] Patent Number: 5,218,804

[45] Date of Patent: Jun. 15, 1993

[54] PREFABRICATED LOAD BEARING PANEL

[76] Inventor: Henry F. Campbell, 21520 Bridge St., Southfield, Mich. 48034

[21] Appl. No.: 774,700

[22] Filed: Oct. 9, 1991

Related U.S. Application Data

[63] Continuation-in-part of Ser. No. 584,459, Sep. 18, 1990, abandoned, which is a continuation-in-part of Ser. No. 445,752, Dec. 4, 1989, abandoned.

[51] Int. Cl.[5] ..... E04B 1/08

[52] U.S. Cl. ..... 52/262; 52/236.3; 52/408; 52/93.1

[58] Field of Search ..... 52/92, 236.3, 634, 636, 52/637, 648, 262, 284, 266, 270, 408

[56] References Cited

U.S. PATENT DOCUMENTS

| | | | |
|---|---|---|---|
| 2,765,498 | 10/1956 | Kelnhofer | 52/92 |
| 3,421,270 | 1/1963 | Chaney | 52/90 |
| 3,882,653 | 5/1975 | Ollman | 52/694 |
| 3,927,498 | 12/1975 | Benedetti | 52/236 |
| 4,295,312 | 10/1981 | Campbell | 52/408 |
| 4,433,514 | 2/1984 | Henges, Jr. et al. | 52/262 |
| 4,559,748 | 12/1985 | Ressel | 52/90 |
| 4,741,139 | 5/1988 | Campbell | 52/408 |
| 4,817,356 | 4/1989 | Scott | 52/729 |

*Primary Examiner*—Henry E. Raduazo
*Assistant Examiner*—Christopher Kent
*Attorney, Agent, or Firm*—Barnes, Kisselle, Raisch, Choate, Whittemore & Hulbert

[57] ABSTRACT

A building construction for industrial, commercial or similar buildings comprising at least one wall made of a plurality of prefabricated panels, each of which comprises to transversely spaced trusses to which spaced sheets are fastened. The panels are assembled on a base wall in side-by-side relationship with the transversely outermost truss of each panel closely adjacent and preferably in abutment with the adjacent outwardly positioned truss of the adjacent panel. A load plate is provided at each of the areas of juncture between panels. Joists, trusses or prefabricated roof panels extend horizontally from the load plates to provide a ceiling or roof structure. The panels comprise a pair of abutting trusses along each side edge of each panel. In another form, each panel includes a pair of trusses adjacent the transverse mid-point which are closely adjacent and preferably in abutting relationship with a load bearing plate at the transverse midpoint.

20 Claims, 5 Drawing Sheets

PREFABRICATED LOAD BEARING PANEL

This application is a continuation-in-part of application Ser. No. 07/584,459 filed Sep. 18, 1990, now abandoned, which is, in turn, a continuation-in-part of application Ser. No. 07/445,752, filed Dec. 4, 1989, now abandoned.

This invention relates to load bearing walls for industrial, commercial or similar building construction.

BACKGROUND AND SUMMARY OF THE INVENTION

In U.S. Pat. No. 3,882,653, there is disclosed prefabricated panels which comprise spaced sheets of relatively thin material and a plurality of longitudinally extending parallel trusses to which the sheets are fastened. Such panels are utilized on a framework of steel columns and horizontal beams to provide external or internal walls. In buildings, it is common to make one building portion in such a manner for manufacturing and warehousing and add another portion of the building such as an office portion having masonry walls. The masonry walls, whether they be load bearing or erected together with steel columns and horizontal beams, necessitate delays to the closing-in process of the overall building so that work cannot proceed to completion within the first portion until the other portion is closed in. Another problem with respect to such masonry construction is that window openings are not usually accurately formed and as in the practice, the openings are measured before the window, frames and panes can be made and inserted which causes further delay in closing-in the building.

Among the objectives of the present invention are to provide a building construction for industrial, commercial or similar buildings utilizing prefabricated panels of the type set forth in the aforementioned patent which can be utilized as load bearing walls to support horizontal joists, trusses or prefabricated roof panels thereby obviating the need for columns and horizontal beams to support the joists, trusses or prefabricated roof panels.

In accordance with the invention, a building construction for industrial, commercial or similar buildings comprising at least one wall made of a plurality of prefabricated panels, each of which comprises two transversely spaced trusses to which spaced sheets are fastened. The panels are assembled on a base wall in side-by-side relationship with the transversely outermost truss of each panel closely adjacent and preferably in abutment with the adjacent outwardly positioned truss of the adjacent panel. A load plate is provided at each of the areas of juncture between panels. Joists, trusses or prefabricated roof panels extend horizontally from the load plates to provide a ceiling or roof structure. The panels comprise a pair of abutting trusses along each side edge of each panel. In another form, each panel includes a pair of trusses adjacent the transverse midpoint which are closely adjacent and preferably in abutting relationship with a load bearing plate at the transverse midpoint.

DESCRIPTION

Figure 1:
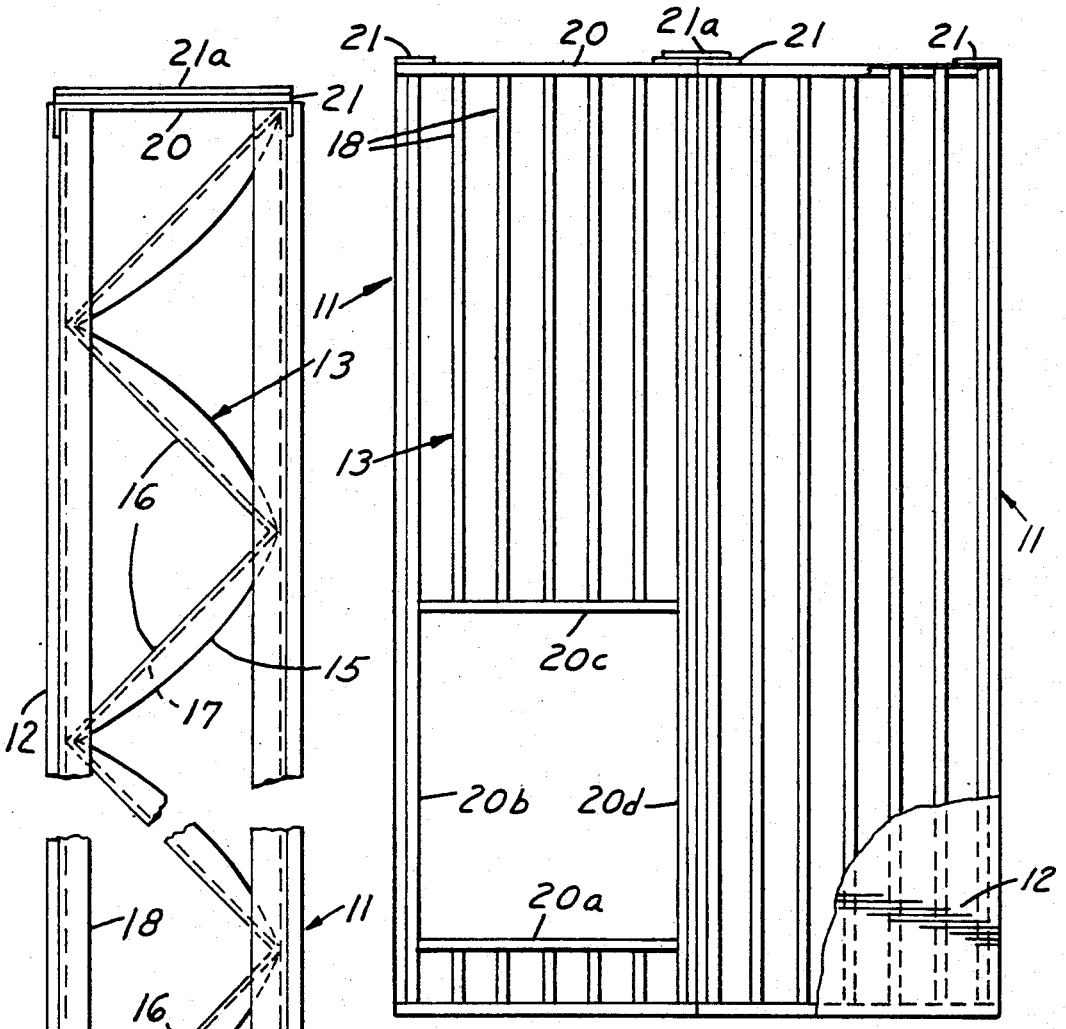
FIG. 1 is a fragmentary elevational view of a wall embodying the invention.
Figure 2:
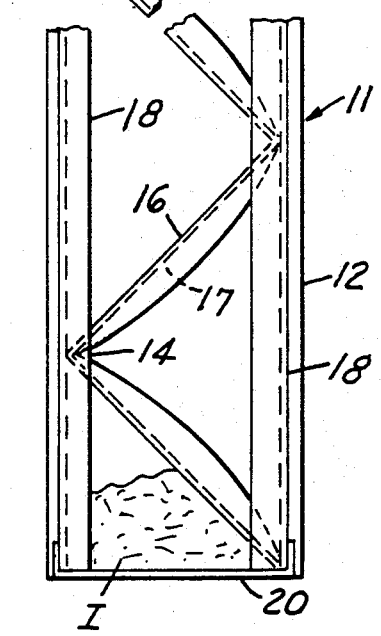
FIG. 2 is a side view of the wall.

Referring to FIG. 1, the building or building portion embodying the invention is made of a plurality of prefabricated panels 11, each of which is of substantially identical construction. As shown in FIGS. 1–7, each prefabricated panel 11 comprises a plurality of parallel longitudinally extending trusses 13. Rectangular sheets 12 of relatively thin material which may bend under its own weight, such as sheet metal, are fastened to the trusses 13. Although two sheets are shown, a single sheet can be used preferably forming an externally facing wall surface.

As shown in U.S. Pat. No. 3,882,653, incorporated herein by reference, each truss 13 preferably comprises a strip of material which has a greater width than thickness, which is non-load bearing longitudinally or transversely such as sheet metal, brown board or gypsum board and the like and includes alternating apices 14 connected by diagonal legs 15. Each leg member 15 has a substantially straight line end portion 16 and a non-flat intermediate portion 17 herein shown as U-shaped in cross section which gradually merges with the straight line end portions 16. By this construction, the apices form relatively sharp V-shaped configurations.

Each truss 13 further comprises metal channel members 18 engaged by the apices 14 of the longitudinally extending members 13. The apices 14 are preferably welded to the channel member 18 and the channel member 18 is bonded to sheets 12 as by screws, welding, riveting, deforming or the use of a suitable adhesive such as epoxy resin or pressure sensitive tape. Caps in the form of channels 20 are applied to the upper and lower portions of each panel overlying the trusses 13. The sheets 12 overlie the side walls of the caps 20. The channels 20 are fastened to the channel members 18 of the trusses as by screws, welding, riveting, deforming or adhesive.

The panels may have other kinds of sheets such as brick, cement surfaces and the like to provide differing appearances.

In accordance with the invention as shown in FIGS. 1–4, each panel comprises a pair of trusses 13 in side-by-side relationship along each longitudinal or side edge which are closely adjacent and preferably in abutment. The panel includes equally spaced trusses 13 between the side edges. As erected, the panels are provided in side-by-side relation with the trusses 13 extending vertically and the edgemost trusses of adjacent panels closely adjacent and preferably in abutting relationship.

Further in accordance with the invention, a load member 21, herein shown a plate 21, is fixed on the channel 20 at one end of panel 11 which is to be the upper end when the panel is positioned vertically. The plate 21 is fastened to the channel 20 as by welding, adhesive or fasteners.

Figure 4:
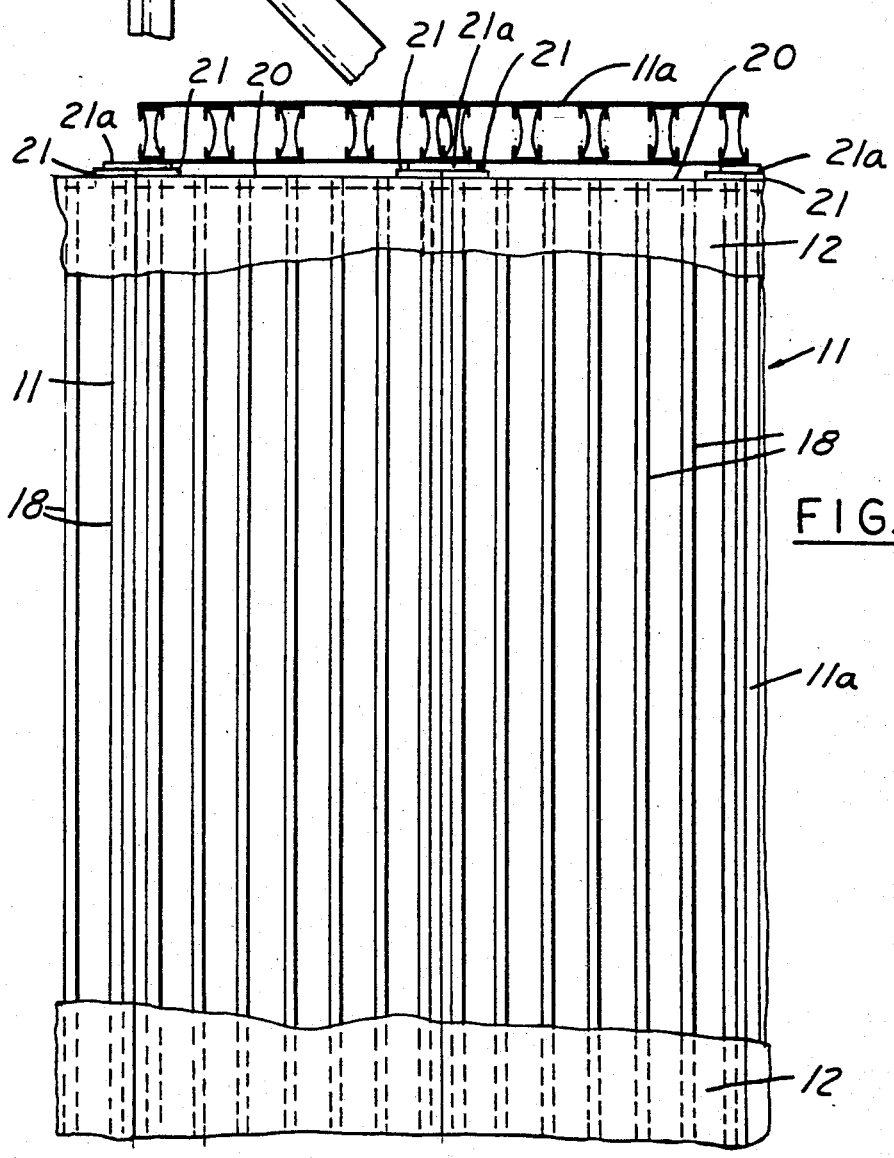
FIG. 4 is a fragmentary elevational view of a portion of a modified wall.

After the panels are positioned vertically a second plate 21*a* is provided spanning the plates the plates 21 as by welding, adhesive or fasteners. Thus, the plate 21*a* spans and is in overlapping relationship to the plates 21 that overly the abutting edge trusses between adjacent panels. The load plates 21*a* serve as a support for one end of horizontal joist or truss at each of the aforementioned locations. Alternatively, instead of joists, horizontal roof panels 11*a* may comprise prefabricated panels that are supported on the plates 21*a* (FIG. 4). It will be noted that the plates 21*a* maintain the major portion of the panel 11*a* in spaced relation to the channel 20 of the underlying panel 11 so that the horizontal panels 11*a* will deflect under load without contacting the panels 11.

Figure 3:
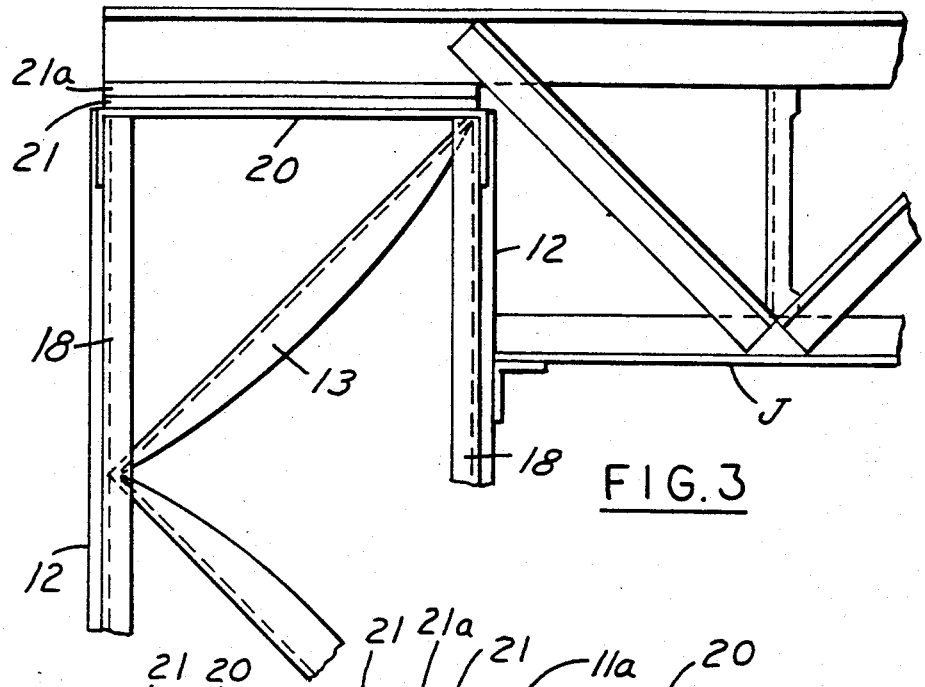
FIG. 3 is a fragmentary sectional view on an enlarged scale of a portion of a panel shown in FIGS. 1 and 2.

In each of these forms, the panels 11 are modified from those shown in the aforementioned U.S. Pat. No. 3,882,653 in that the free ends of the channel members 18 are cut off at 90° and abut directly on the channels 20 in order that the load on the channels 20 is transferred directly to the channel members 18 of trusses 13 underlying the load (FIG. 3).

Thus, for example, the panel may have a height of 20', a width of 8' with trusses spaced 12" apart and a pair of trusses at each longitudinal edge for a total of 11 trusses.

Figure 6:
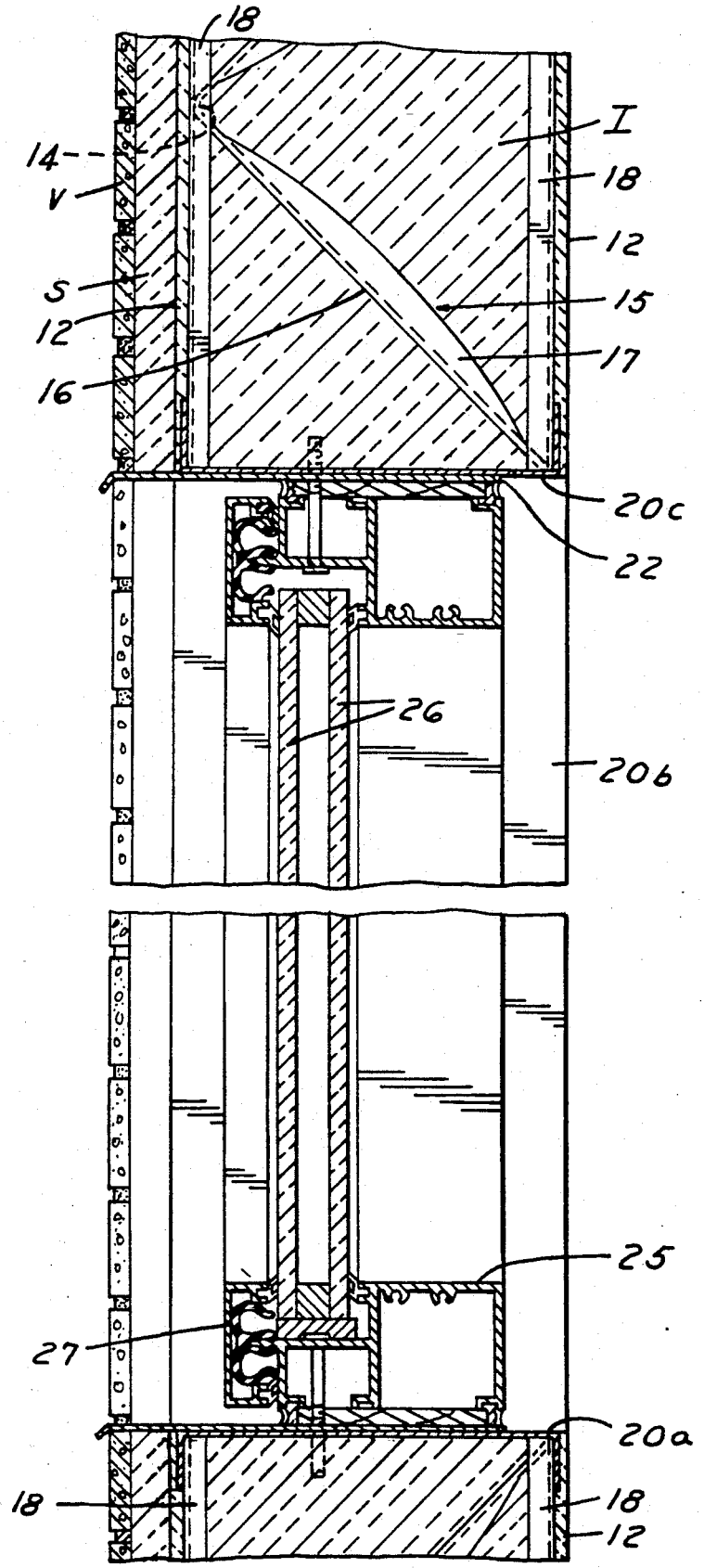
FIG. 6 is a fragmentary sectional enlarged view of a modified wall.
Figure 9:
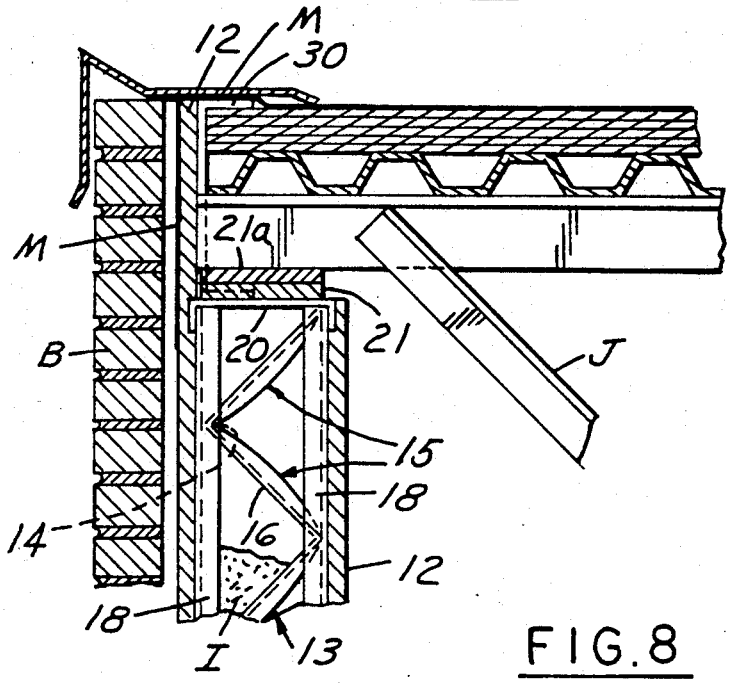
FIG. 9 is a fragmentary sectional view on an enlarged scale of a portion of the construction shown in FIG. 7.
Figure 8:
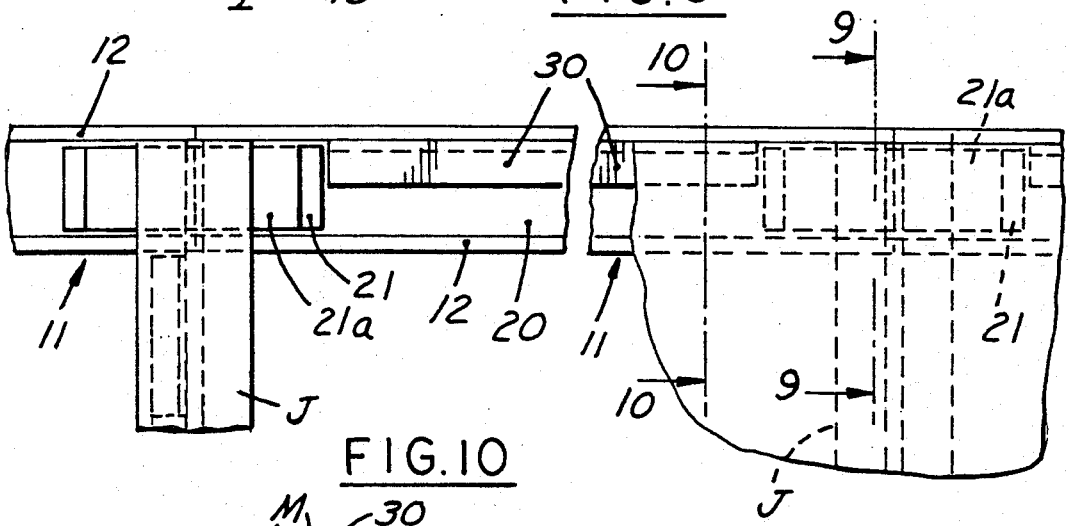
FIG. 8 is a fragmentary plan view of a portion of the construction shown in FIG. 7, portions being broken away.
Figure 10:
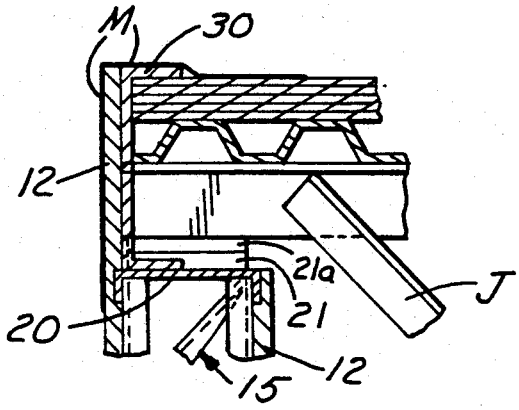
FIG. 10 is a view similar to FIG. 9 showing parts being broken away.

The panel may further include, as desired, an opening 22, provided with channels 20*a*, 20*b*, 20*c* and 20*d* containing a prefabricated window frame 25 and sash which is delivered to the job site without glass panes (FIGS. 1, 6). Inasmuch as the window can be accurately formed by jigs and fixtures away from the job site, when erected the panels define an opening. Precut panes 26 can be brought to the job site and placed in position, the retaining member 27 is then applied, thus immediately closing the building. This may be contrasted to present day construction practice wherein a window opening is formed in a masonry wall, for example, and then the opening must be measured and the frame and glass panes cut to the adjusted dimensions because the openings may not be square and uniform. Alternatively, the panes could be assembled in the window away from the job site. The spacing of the trusses intermediate the side edges is preferably equal, as in the previous form, namely, 1 foot or 16 inches but can be at varying spacing.

Figure 5:
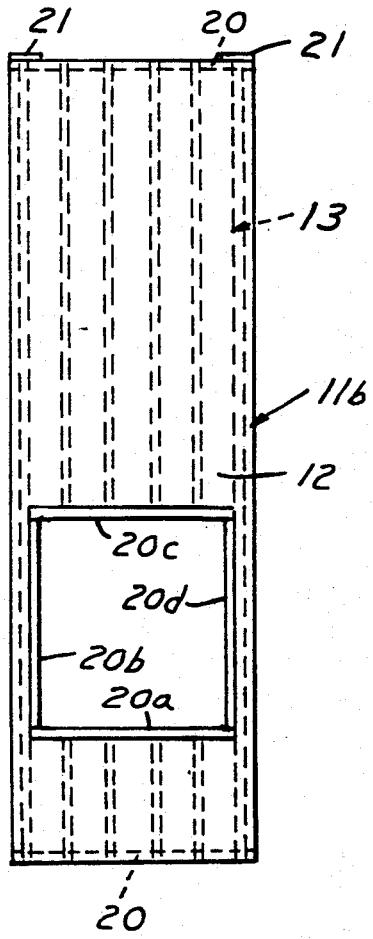
FIG. 5 is a fragmentary elevational view of a modified wall embodying the invention.

In the form of the invention shown in FIG. 5, the panels 11*b* are made more narrow than the panels 11, that is, having fewer trusses 13 but at the same spacing.

Figure 7:
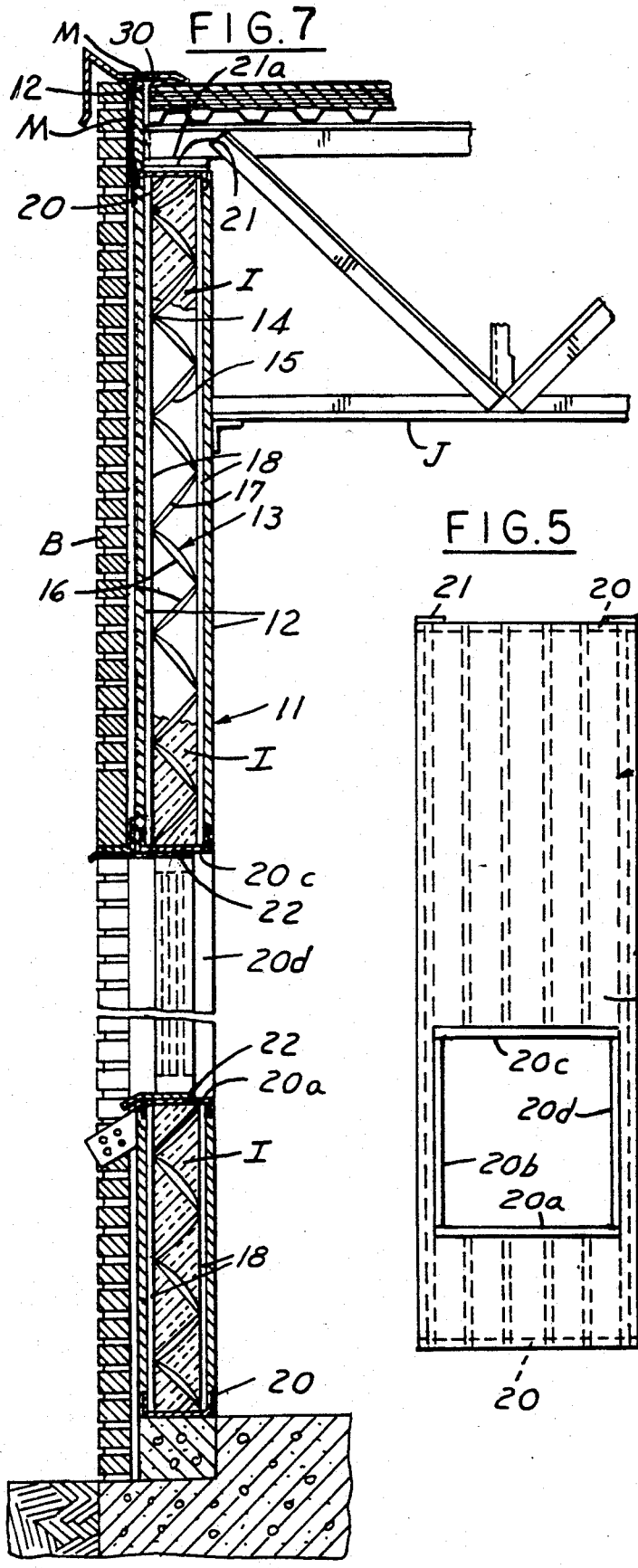
FIG. 7 is a vertical sectional view of a wall in position in a building.

In the form of the invention shown in FIG. 7, a brick wall B is erected on the outside of the panels after the panels are erected. In the form shown in FIG. 6, a brick veneer V is provided on the outer sheet S of the panels. In both these forms, the sheets 12 comprise relatively rigid panels such as gypsum board sheets but the sheets do not take vertical load.

As shown in FIGS. 7, 8, 9 and 10, the panel further includes a C-section, light weight metal member 30 which rests on and is fixed to the upper channel 20 between the plates 21 so that no load is applied thereto. The sheet 12 extends along the vertical portion of the C-section member 30. C-section member 30 is fastened to channel 20 by fasteners, adhesive or welding. The space between the horizontal portions of C-section member 30 receive the roofing deck and roofing. A roofing sheet such as rubber or plastic membrane M is provided on the roof and extends between the brick wall and the outer sheet 12. A cap is provided over the intersection of the roof and brick wall.

In all the forms, the depth of the trusses 13 provides maximum space for insulation material I such as glass fiber and the like.

When the trusses are of metal and the sheets of metal or incombustible material such as gypsum board, then the brick veneer (FIG. 6) or brick wall (FIG. 7) and the glass fiber insulation offers fire resistance.

It can thus be seen that there has been provided a building construction for industrial, commercial or similar buildings utilizing prefabricated panels which can be utilized as load bearing walls to support horizontal joists thereby obviating the need for columns and horizontal beams to support the joists. As a result, it is possible to enclose the office portion of a building, being made of panels as is the industrial portion without the need for delays in erecting columns, horizontal beams and the associated masonry. Further, the prefabrication of the panels with accurately formed openings eliminates the time delays in measurement of window openings and cutting of frames and glass panes where masonry construction is used, leaving the building open to trespass, necessitating delays and obviating the adverse effects of weather.

I claim:

1. A building construction comprising at least one load bearing wall comprising a plurality of load bearing prefabricated panels, each of said load bearing panels comprising transversely spaced trusses having upper and lower ends, vertical edges and a transverse midpoint, each of said panels having outermost trusses, each of said load bearing panels including cap members overlying the upper ends and the lower ends of said trusses, each of said trusses comprising spaced channel members and an undulating strip between said channel members, each of said channel members having ends and a length, the ends of each of said channel members being at a right angle to the length of said channel members and abutting said cap members, at least one sheet fastened to said trusses of each of said panels, a base wall, said panels being adapted to be assembled on said base wall in side-by-side, closely adjacent relationship with one of said outermost trusses of each of said panels adjacent with the adjacent outermost truss of the adjacent panel defining an area of juncture, first load member plate means fastened to one end of each of said panels in overlying relation to said outermost truss such that a load applied to said load member plate is transmitted through the cap member to the ends of the channel member of said truss, second load member plate means overlying and said fastened to the first load member plate means of adjacent panels, and a construction load engaging only said second load member plate means such that said load is transferred to the panels only through said second load member plate means and the underlying first load plate means.

2. The building construction set forth in claim 1 wherein each of said panels includes a pair of trusses along the vertical edges thereof, said pair of trusses being in closely spaced relation, said first load member plate means overlying said two trusses of adjacent panels.

3. The building construction set forth in claim 1 wherein each of said panels includes a pair of trusses intermediate the vertical edges thereof, said pair of trusses being in closely spaced relation defining an area of juncture, and third load member plate means being positioned at the area of juncture of said two trusses.

4. The building construction set forth in claim 1 wherein each of said panels includes a pair of trusses adjacent the transverse midpoint which are in closely adjacent relation defining an area of juncture, and third load member plate means being positioned at the area of juncture of said two trusses adjacent the midpoint of each panel.

5. The building construction set forth in claim 1 wherein at least one of said prefabricated panels includes an opening, a window frame mounted in said one of said panels and a sash in the frame.

6. The building construction set forth in anyone of claims 1–5 includes a C-shaped member fixed to one of said cap members on said one end of said panel between said load member plate means and the adjacent load plate means.

7. The building construction as set forth in claim 1 wherein said construction load comprises a joist.

8. The building construction set forth in claim 1 wherein said construction load comprises a plurality of said prefabricated panels.

9. A prefabricated panel comprising parallel spaced trusses, each of said trusses having an upper end and a lower end, vertical edges and a transverse midpoint, said panel including a pair of trusses along each side of edges of said panels, each of said pair of trusses being in closely spaced adjacent relation, and each of said trusses comprising spaced channel members and an undulating strip between said channel members, each of said channel members having upper and lower ends and a length, cap members overlying the upper and lower ends of said trusses, the ends of each of said channel members being at a right angle to the length of the channel members and abutting said cap members, spaced sheets fastened to said trusses and extending longitudinally thereof, a load member plate means fastened to said panel in overlying relation to each pair of trusses such that a load applied to said load member plate means is transmitted through the cap member to the ends of the channel members of each pair of trusses.

10. The prefabricated panel set forth in claim 9 including a pair of trusses at the mid-point of said panel.

11. The prefabricated panel set forth in claim 9 wherein said panel includes an opening, a window frame mounted in the opening and a sash in the frame.

12. The prefabricated panel set forth in claim 11 wherein said opening extends from the trusses at the side edges and between the side edges.

13. The prefabricated panel set forth in any one of claims 9–12 including a C-shaped member fixed to said cap member on said one end of said panel between said load member plate means and the adjacent load member plate means.

14. A building construction comprising at least one wall made of a plurality of prefabricated panels, each panel comprising spaced trusses, each of said trusses having an upper end and a lower end, vertical edges and a transverse midpoint, each of said panels having outermost trusses, each of said panels including cap members overlying the upper ends and the lower ends of said trusses, each of said trusses comprises spaced channel members and an undulating strip between said channel members, each of said channel members having ends and a length, the ends of each of said channel members being at a right angle to the length of said channel members and abutting said cap members, said sheets fastened to said trusses, a base wall, said panels being assembled on a base wall in side-by-side closely adjacent relationship defining an area of juncture with the transversely outermost truss of each of said panels adjacent one of said panels with the adjacent outwardly positioned truss of the adjacent panel defining an area of juncture, load member plate means overlying and fastened to one end of each of said panels at least at the areas of juncture between said panels, and roof load members having one end engaging only said load member plate means to provide a ceiling or roof structure such that a load is applied to said panels solely through said load member plate means.

15. The building construction set forth in claim 14 wherein each panel includes a pair of trusses along the vertical edges thereof, said pair of trusses being in closely spaced relation, said load member plate means overlying said two trusses of adjacent panels.

16. The building construction set forth in claim 14 wherein each of said panels includes a pair of trusses intermediate the vertical edges thereof, said pair of trusses being in closely spaced relation defining an area of juncture, and load member plate means being positioned at the area of juncture of said two trusses.

17. The building construction set forth in claim 14 wherein each of said panels includes a pair of trusses adjacent the transverse mid-point which are in closely adjacent relationship defining an area of juncture, and load member plate means being positioned at the area of juncture of said two trusses adjacent the mid-point of each panel.

18. The building construction set forth in claim 14 wherein at least one of said prefabricated panels includes an opening, a window frame mounted in said one of said panels, a sash in the frame.

19. The building construction set forth in claim 18 wherein said opening extends from the trusses at the side edges and between the side edges.

20. The building construction set forth in anyone of claims 14–19 including a C-shaped member fixed to said cap member on said one end of said panel between said load member plate means and the adjacent load member plate means.

* * * * *